US005154571A

United States Patent [19]

Prümper

[11] Patent Number: 5,154,571

[45] Date of Patent: Oct. 13, 1992

[54] GEARED TURBOCOMPRESSOR

[75] Inventor: Heinrich Prümper, Berlin, Fed. Rep. of Germany

[73] Assignee: Deutsche Babcock-Borsig Aktiengesellschaft, Berlin, Fed. Rep. of Germany

[21] Appl. No.: 651,280

[22] Filed: Feb. 5, 1991

[30] Foreign Application Priority Data

Feb. 6, 1990 [DE] Fed. Rep. of Germany ..... 4003482

[51] Int. Cl.[5] ..... F01D 13/00

[52] U.S. Cl. ..... 415/60; 415/124.1; 417/423.5; 417/423.6; 417/426; 417/405; 74/665 GA; 74/462

[58] Field of Search ..... 415/60, 122.1, 124.1; 417/423.5, 423.6, 426, 373, 405; 74/665 GA, 462

[56] References Cited

U.S. PATENT DOCUMENTS 2,955,924 10/1960 Smith ..... 415/122.1
3,001,692 9/1961 Schierl ..... 415/122.1
3,060,755 10/1962 De Brosse et al. ..... 74/665 GA
3,741,676 6/1973 Silvern et al. ..... 415/122.1
4,294,132 10/1981 Matusz ..... 74/462

FOREIGN PATENT DOCUMENTS 0685397 12/1939 Fed. Rep. of Germany ..... 74/665 GA
0102821 1/1924 France ..... 415/60

*Primary Examiner*—Edward K. Look
*Assistant Examiner*—Christopher M. Verdier
*Attorney, Agent, or Firm*—Max Fogiel

[57] ABSTRACT

A multistage turbocompressor with a two-stage transmission with a double intermediate cogwheel (5) consisting of two cogwheels (51 and 52). The first cogwheel has a larger module than the second cogwheel and engages only a central cogwheel (2) that drives the pinion shafts (3 & 4) in the first stage. The second cogwheel engages only the pinion shafts (6, 7, & 8) in the second stage.

8 Claims, 1 Drawing Sheet

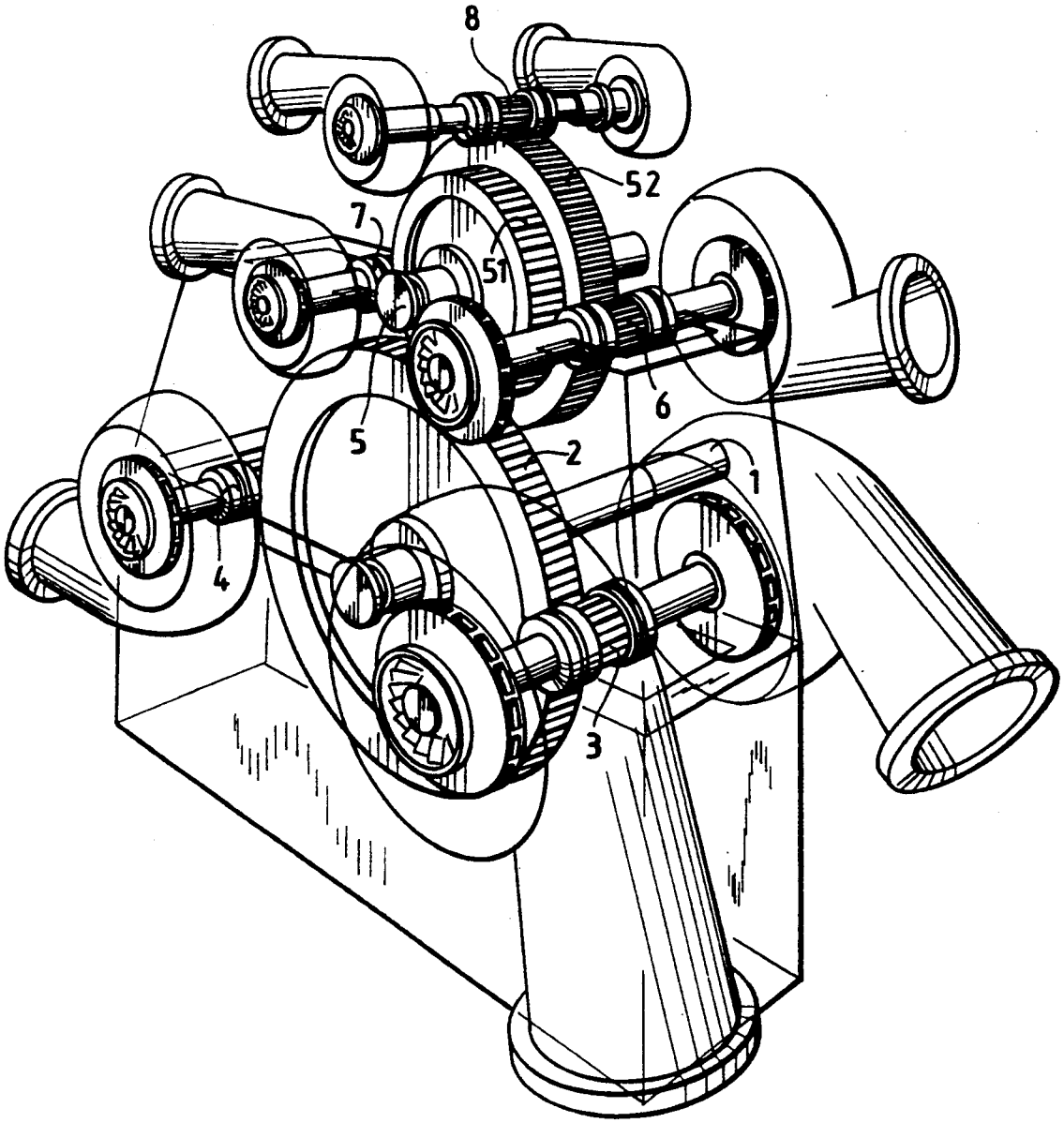
8
52
7
51
6
5
2
1
4
3

GEARED TURBOCOMPRESSOR

BACKGROUND OF THE INVENTION

The invention concerns what is called a geared turbocompressor, a multistage turbocompressor operated by way of a transmission.

A known turbocompressor of this genus (cf. Dubbel, Taschenbuch für den Maschinenbau, 14th ed., 1981, 920–21) has four compressor stages with pairs of impellers mounted on two pinion shafts and driven by way of a cogwheel at the center of a single-stage transmission.

The attainable efficiency of a turbocompressor stage depends on intake, revolutions per minute, and head. At ratios of $P_A:P_E>60$, where $P_A$ is output pressure and $P_E$ is terminal pressure, seven stages are needed, whereas at least eight are necessary for $P_A:P_E>80$. The flow varies considerably from stage to stage. The speed must accordingly be increased after every two stages to obtain optimal conditions. The pinion shaft in the final stage of an optimal compressor must rotate so much more rapidly than the driveshaft that the requisite transmission ratio of more than 1:24 cannot be obtained in a conventional transmission.

Five-stage and six-stage geared turbocompressors have so far been designed for maximal pressure ratios of $P_A:P_E=40$. A single-stage transmission must be equipped with three pinion shafts for this purpose. Each pinion shaft drives two directly mounted impellers that constitute two stages. A six-stage compressor with a mean pressure ratio of 1.8 per stage can attain an overall ratio of $P_A:P_E=34$. Heavily loaded stages with a mean pressure ratio of 2.0 per stage would provide an overall ratio of $P_A:P_E=64$. Such a compressor would be difficult to control, and the overall efficiency would be very unsatisfactory due to its high Mach numbers.

Pressure ratios higher than 60 can be attained only by adding a seventh or eighth stage if such essential properties as regulation capability and high overall efficiency are to be retained. Attempts to attain maximal efficiency, however, have failed because the maximal ratio attainable in known turbocompressor transmissions is approximately 1:20. For high outputs and electric motors with four poles, this means a maximal speed of 30 000 R.P.M. With this maximum as a point of departure, uniform optimal efficiencies will be impossible in any turbocompressor with flow rates below 60 000 $m^3/h$ and pressure ratios higher than 60 because the heads in the early stages must be considerably higher than those in the later stages. The early stages will accordingly have the highest energy density and only moderate efficiencies because of the unavoidably high Mach numbers. The seventh stage of a seven-stage turbocompressor with a flow of 55 000 $m^3/h$ and a pressure ratio of $P_A:P_E=64$ would have to turn at 35 000 R.P.M. although conventional turbocompressor transmissions can attain only 28 000 R.P.M. The overall efficiency is accordingly not optimal. It is of course possible to provide the fourth pinion shaft with an eighth stage, although the basic problematics of limited speeds would still remain, with the aforesaid consequences.

SUMMARY OF THE INVENTION

The object of the present invention is accordingly a geared turbocompressor that will provide high pressure ratios at satisfactory efficiencies and that can be adequately controlled.

The intermediate double cogwheel with teeth of various modules ensures a turbocompressor transmission that will generate moderate speeds in the low stages and very high speeds in the higher stages without the number of teeth in the central driving cogwheel depending on the number of teeth in the pinions associated with the higher stages. The lower speeds with their powerful bites will demand wide teeth and a high module, whereas the higher speeds with their lower bites will be able to get along with narrower wheels and a finer module. The intermediate cogwheel with its different modules will also allow two independent turbocompressor transmissions to be employed in one housing and makes it possible to obtain ratios of up to 40. It is accordingly possible to attain optimal efficiencies even with turbocompressors designed for high pressure ratios. The overall efficiency is more than 5% better, signifying considerable savings in energy costs.

One embodiment of the invention is illustrated in the drawing and will now be specified.

BRIEF DESCRIPTION OF THE DRAWINGS

A perspective view and shows the essential elements and their interconnections and relationships, according to the present invention.

DESCRIPTION OF THE PREFERRED EMBODIMENTS

The illustrated transmission is employed to drive a multistage turbocompressor and contains a central driving cogwheel 2 mounted on a driveshaft 1. Driving cogwheel 2 meshes with two pinions, each on a pinion shaft 3 and 4. The impeller of one stage is mounted on one end of pinion shaft 3 and the impeller of another stage is mounted on the other end. A third impeller is mounted on one end of pinion shaft 4 and an unillustrated fourth impeller is mounted on its other end. Each impeller rotates inside a spiral housing.

Downstream of driving cogwheel 2 is an intermediate double cogwheel 5 that consists of two wheels 51 and 52 attached together and mounted on the same shaft. Cogwheel 51 meshes with driving cogwheel 2 and cogwheel 52 with pinions on additional shafts 6, 7, and 8. An impeller rotates in a spiral housing on each end of each pinion shaft. Pinion shaft 6 is associated with the fifth and sixth stages, pinion shaft 7 with the seventh and eighth stages, and pinion shaft 8 with the ninth and tenth stages.

Since the diameter of the second cogwheel 52 in double cogwheel 5 is longer than that of first cogwheel 51, which engages driving cogwheel 2, the pressure meshes of pinion shafts 6, 7, and 8 can engage by way of cogwheel 52. First cogwheel 51 has a lower number of teeth and a larger module than second cogwheel 52 does.

The interposition of aforesaid intermediate cogwheel 5 allows, due to the difference in modules, the first four stages to be operated completely independent from the downstream stages in terms of transmission technology. The requisite transmission ratio for pinion shaft 4 is approximately 10.5. If the number of teeth in the pinion of shaft 4 is $Z2=25$, driving cogwheel 2 will have $Z0=263$ teeth, which will result, for a module of 6, in a diameter of $D0=1575$ mm and a tooth-engagement rate of 122 m/sec. The diameter of the housing spiral of the first and second stages will determine, as is usual with known turbocompressor transmissions, the axial separation of pinion shafts 3 and 4, which will be 1800 mm in this case if the diameter of driving cogwheel 2 is 1696 mm and if it has Z0=266 teeth.

The first cogwheel 51 in intermediate cogwheel 5, which engages driving cogwheel 2, has approximately Z51=132 teeth and a diameter of 790 mm, turning a 3000 R.P.M.

In an eight-stage compressor, pinion shaft 7 will turn a 34 730 R.P.M. Assuming Z4=21 teeth, second cogwheel 52 would have Z52=243 teeth. At a module of 4, the diameter will be 972 mm and the tooth-engagement rate 150 m/sec. The overall moment of inertia can be assumed due to the moderate diameter and will allow the motor upstream of the transmission to start up without any problems.

I claim:

1. A compressor drive with a plurality of lower and higher compression stages, comprising: a rotor in each stage; a pinion shaft mounting said rotor at an end of said pinion shaft; a pinion on said shaft; a transmission in said compressor drive and having a central driving gear and an intermediate gear with a first gear and a second gear; said first gear having a larger tooth module than said second gear; said central driving gear meshing with pinions on pinion shafts in lower compression stages and meshing with said first gear of said intermediate gear; said second gear of said intermediate gear meshing with pinions on pinion shafts in higher compression stages.

2. A compressor drive with a plurality of lower and higher compression stages, comprising: a rotor in each stage; a pinion shaft mounting said rotor at an end of said pinion shaft; a pinion on said shaft; a transmission in said compressor drive and having a central driving gear and an intermediate gear with a first gear and a second gear; said first gear having a larger tooth module than said second gear; said central driving gear meshing with pinions on pinion shafts in lower compression stages and meshing with said first gear of said intermediate gear; said second gear of said intermediate gear meshing with pinions on pinion shafts in higher compression stages; said higher compression stages generating substantially high speeds relative to moderate speeds generated by said lower compression stages, said central driving gear having a number of teeth independent of the number of teeth on said pinions in said higher compression stages.

3. A compressor drive as defined in claim 1, wherein said first gear has a diameter less than the diameter of said second gear.

4. A compressor drive as defined in claim 2, wherein said first gear has a diameter less than the diameter of said second gear.

5. A compressor drive as defined in claim 2, including a spiral housing, each rotor rotating inside said spiral housing.

6. A compressor drive as defined in claim 2, wherein said first gear has a smaller number of teeth and a larger modulus than said second gear.

7. A compressor drive as defined in claim 2, wherein a first number of compression stages are operated independent of a second number of compression stages downstream of said first number of compression stages.

8. A compressor drive with a plurality of lower and higher compression stages, comprising: a rotor in each stage; a pinion shaft mounting said rotor at an end of said pinion shaft; a pinion on said shaft; a transmission in said compressor drive and having a central driving gear and an intermediate gear with a first gear and a second gear; said first gear having a larger tooth module than said second gear; said central driving gear meshing with pinions on pinion shafts in lower compression stages and meshing with said first gear of said intermediate gear; said second gear of said intermediate gear meshing with pinions on pinion shafts in higher compression stages; said higher compression stages generating substantially high speeds relative to moderate speeds generated by said lower compression stages, said central driving gear having a number of teeth independent of the number of teeth on said pinions in said higher compression stages; said first gear having a diameter less than the diameter of said second gear; a spiral housing for each rotor, each rotor rotating inside said spiral housing; said first gear having a smaller number of teeth and a larger modulus than said second gear; a first number of compression stages being operable independent of a second number of compression stages downstream of said first compression stages.

* * * * *